US007455430B2

(12) United States Patent
Huang

(10) Patent No.: US 7,455,430 B2
(45) Date of Patent: Nov. 25, 2008

(54) LIGHTING DEVICE WITH A MULTIPLE LAYER COOLING STRUCTURE

(75) Inventor: Bin-Juine Huang, Taipei (TW)

(73) Assignee: Advanced Thermal Devices, Inc., Taipei (TW)

( * ) Notice: Subject to any disclaimer, the term of this patent is extended or adjusted under 35 U.S.C. 154(b) by 199 days.

(21) Appl. No.: 11/326,331

(22) Filed: Jan. 6, 2006

(65) Prior Publication Data

US 2007/0159827 A1 Jul. 12, 2007

(51) Int. Cl.
*F21V 29/00* (2006.01)

(52) U.S. Cl. ..... 362/294; 362/345; 362/547; 362/373; 362/264

(58) Field of Classification Search ..... 362/294, 362/345, 547, 373, 264, 365, 800; 165/104.33
See application file for complete search history.

(56) References Cited

U.S. PATENT DOCUMENTS 4,729,076 A * 3/1988 Masami et al. ..... 362/235
6,910,794 B2 * 6/2005 Rice ..... 362/547
7,210,832 B2 * 5/2007 Huang ..... 362/547
2004/0213016 A1 * 10/2004 Rice ..... 362/547

* cited by examiner

*Primary Examiner*—Jacob Choi
(74) *Attorney, Agent, or Firm*—Rosenberg, Klein & Lee

(57) ABSTRACT

A lighting device with a multiple cooling layer structure has at least one mounting heat conductive block, at least one light assembly and multiple heatsinks. The mounting heat conductive block has a front end, a rear end, a side and at least one shoulder. Each shoulder is formed at the side of the mounting bracket. The light assembly is mounted on the front end of the mounting bracket. Each heatsinks is mounted on one of the shoulders and the rear end of the mounting bracket. When the lighting device generates heat, the heat is able to drive away from the mounting bracket to the heatsinks. The lighting device is able to cool down. The mounting heat conductive block and the heat sinks are easy to manufacture and transfer heat more effectively.

7 Claims, 8 Drawing Sheets

LIGHTING DEVICE WITH A MULTIPLE LAYER COOLING STRUCTURE

BACKGROUND OF THE INVENTION

1. Field of the Invention

The present invention relates to a lighting device, and more particularly to a lighting device with a multiple layer cooling structure that cools effectively and is easy to manufacture.

2. Description of Related Art

With reference to FIG. 9, a conventional lighting device comprises a casing (70), a light assembly (72) and a mounting rod (71). The casing (70) is hollow and also functions as a heatsink. The light assembly (72) is mounted inside the casing (70) and has multiple light emitting diodes (LEDs) (73). The mounting rod (71) has a proximal end and a distal end. The proximal end of the mounting rod (71) can be mounted at any location where light is required. The distal end of the mounting rod (71) is attached to the casing (70).

When the light assembly (72) is used, the LEDs (73) generate a significant amount of heat. Since most LEDs (73) only operate effectively in environments below 120° C., the LEDs (73) overheat and fail in environments above 120° C. The casing (70) dissipates heat to some extend from the light assembly (72) and cools the LEDs (73).

However, most casings (70) for outdoor applications must be sturdy and are cast, and the cast casings (70) are expensive and heavier than stamped casings for indoor or protected applications. Furthermore, the casing (70) is only a single-layer so the total surface area and commensurate heat dissipation capability of the casing (70) are limited. The limited total surface area of the casing (70) is not able to dissipate enough heat from the light assembly (72).

To overcome the shortcomings, the present invention provides a lighting device with a multiple layer cooling structure to obviate or mitigate the aforementioned problems.

SUMMARY OF THE INVENTION

The primary objective of the present invention is to provide a lighting device with a multiole layer cooling structure that is easy to manufacture and cools more effectively.

The lighting device with a multiple layer cooling structure has at least one mounting heat conductive block, at least one light assembly and multiple heatsinks. The mounting heat conductive block has a front end, a rear end, a side and at least one shoulder. Each shoulder is formed at the side of the mounting bracket. The light assembly is mounted on the front end of the mounting bracket. Each heatsinks is mounted on one of the shoulders and the rear end of the mounting bracket. When the lighting device generates heat, the heat is able to be driven away from the mounting bracket to the heatsinks. The lighting device is able to cool down. The mounting heat conductive block and the heatsinks are easy to manufacture and transfer heat more effectively Other objectives, advantages and novel features of the invention will become more apparent from the following detailed description when taken in conjunction with the accompanying drawings.

DETAILED DESCRIPTION OF THE PREFERRED EMBODIMENT

Figure 1:
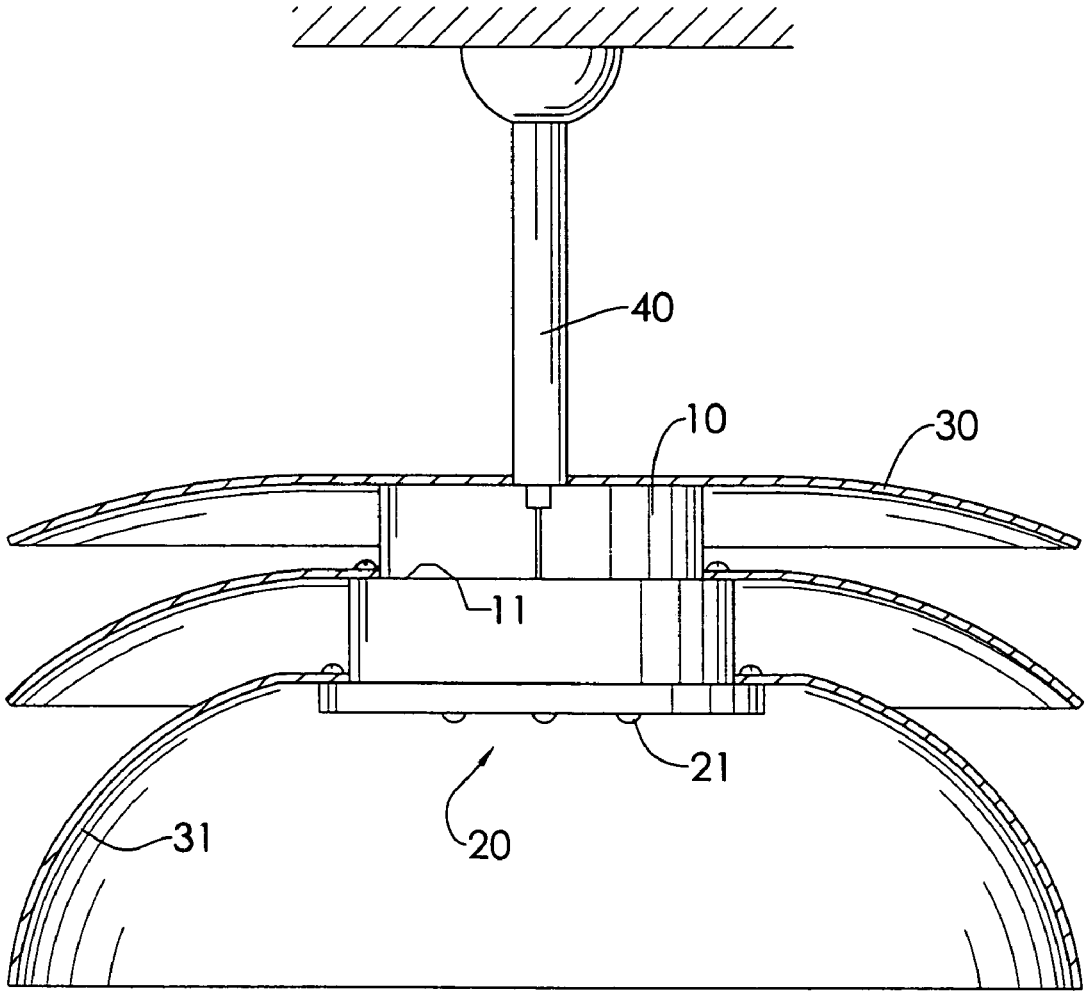
FIG. 1 is a side view in partial section of a first embodiment of a lighting device with a multiple layer cooling structure in accordance with the present invention.
Figure 2:
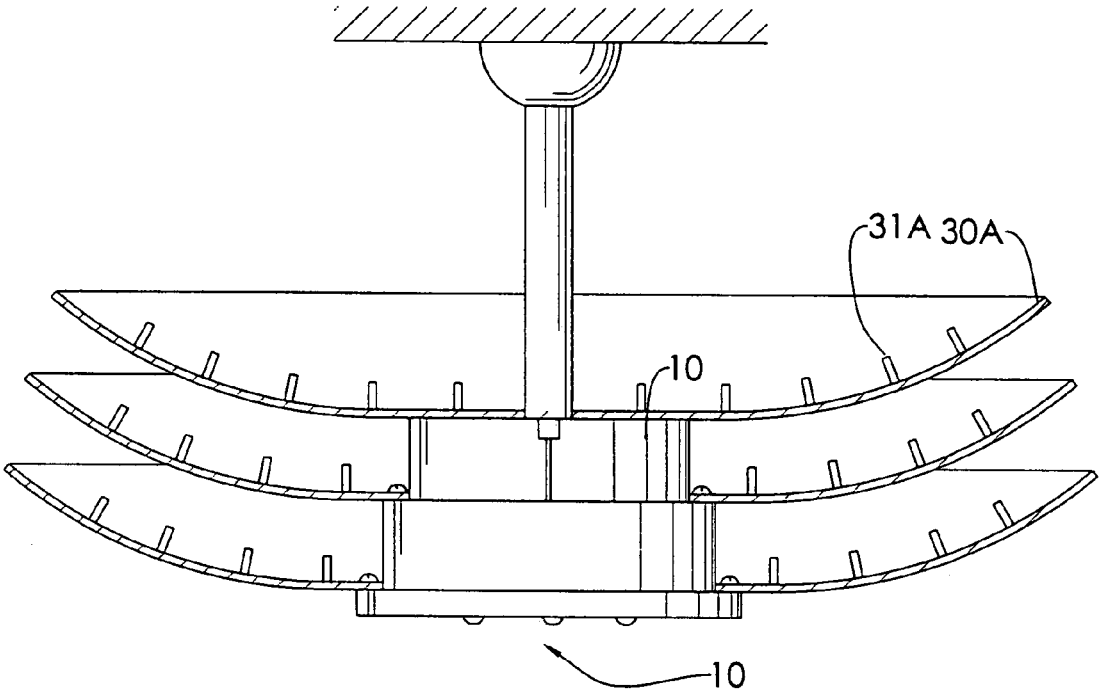
FIG. 2 is a side view in partial section of a second embodiment of the lighting device with a multiple layer cooling structure in accordance with the present invention
Figure 3:
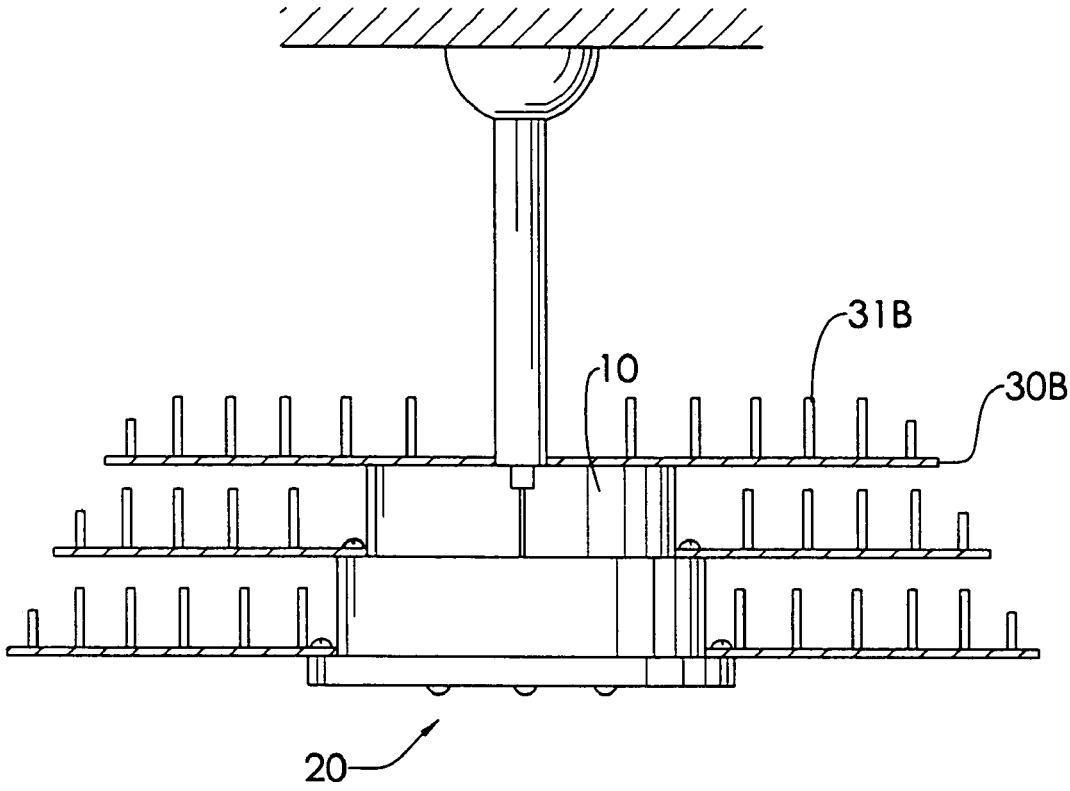
FIG. 3 is a side view in partial section of a third embodiment of the lighting device with a multiple layer cooling structure - in accordance with the present invention.
Figure 4:
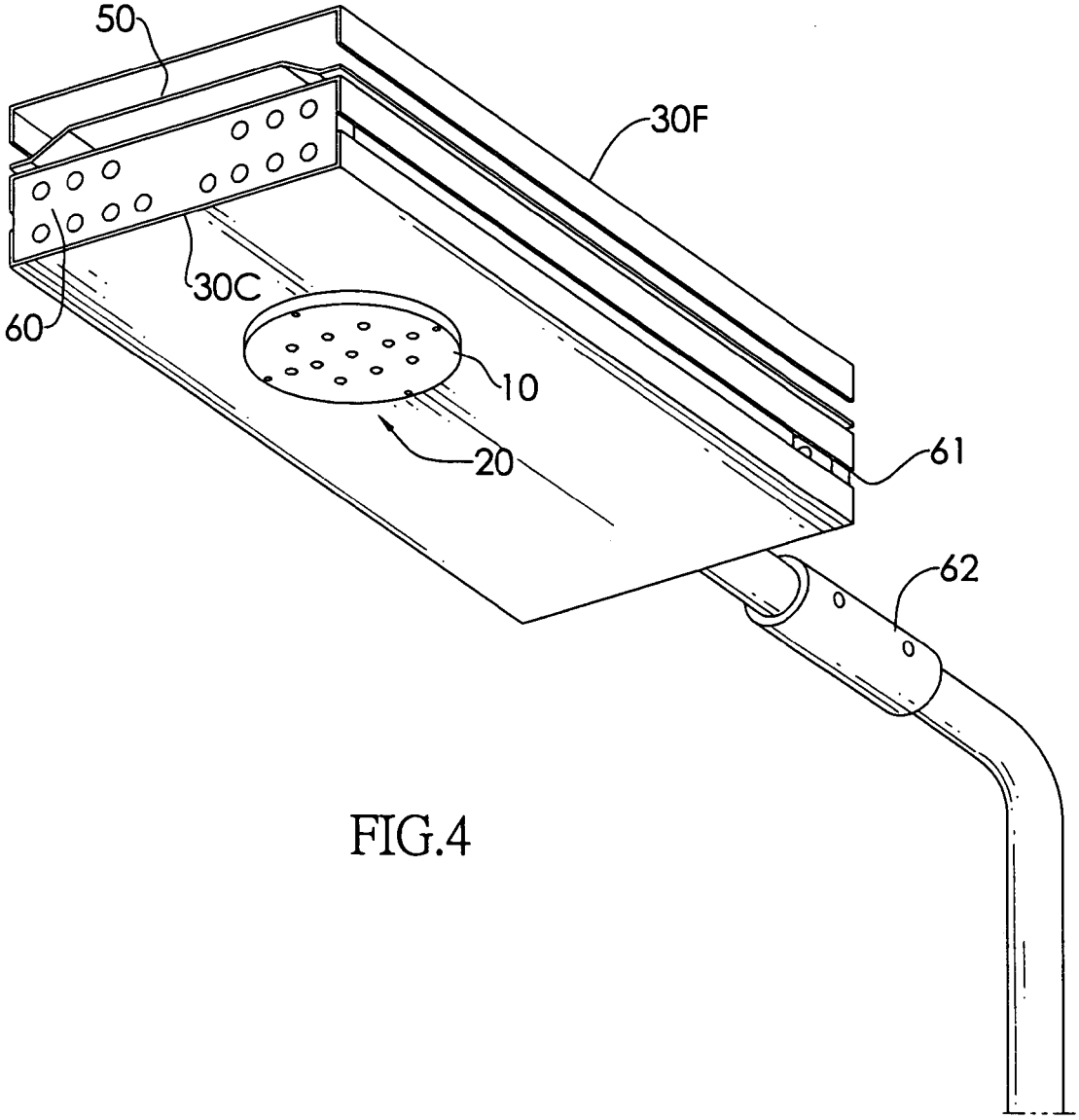
FIG. 4 is a perspective view of a fourth embodiment of the lighting device with a multiple cooling layer structure in accordance with the present invention.

With reference to FIGS. 1, 2, 3, 4, 5 and 8, a lighting device with a multiple layer cooling structure in accordance with the present invention comprises at least one mounting bracket (10), at least one light assembly (20), multiple heatsinks (30, 30A, 3013, 30C, 30D, 30E) and an optional mounting rod (40, 62).

The least one mounting bracket (10) has a front end, a rear end, a side and multiple shoulders(11). Each shoulder (11) is formed on and protrudes out from the of side of the monuting barcket(10).

Figure 8:
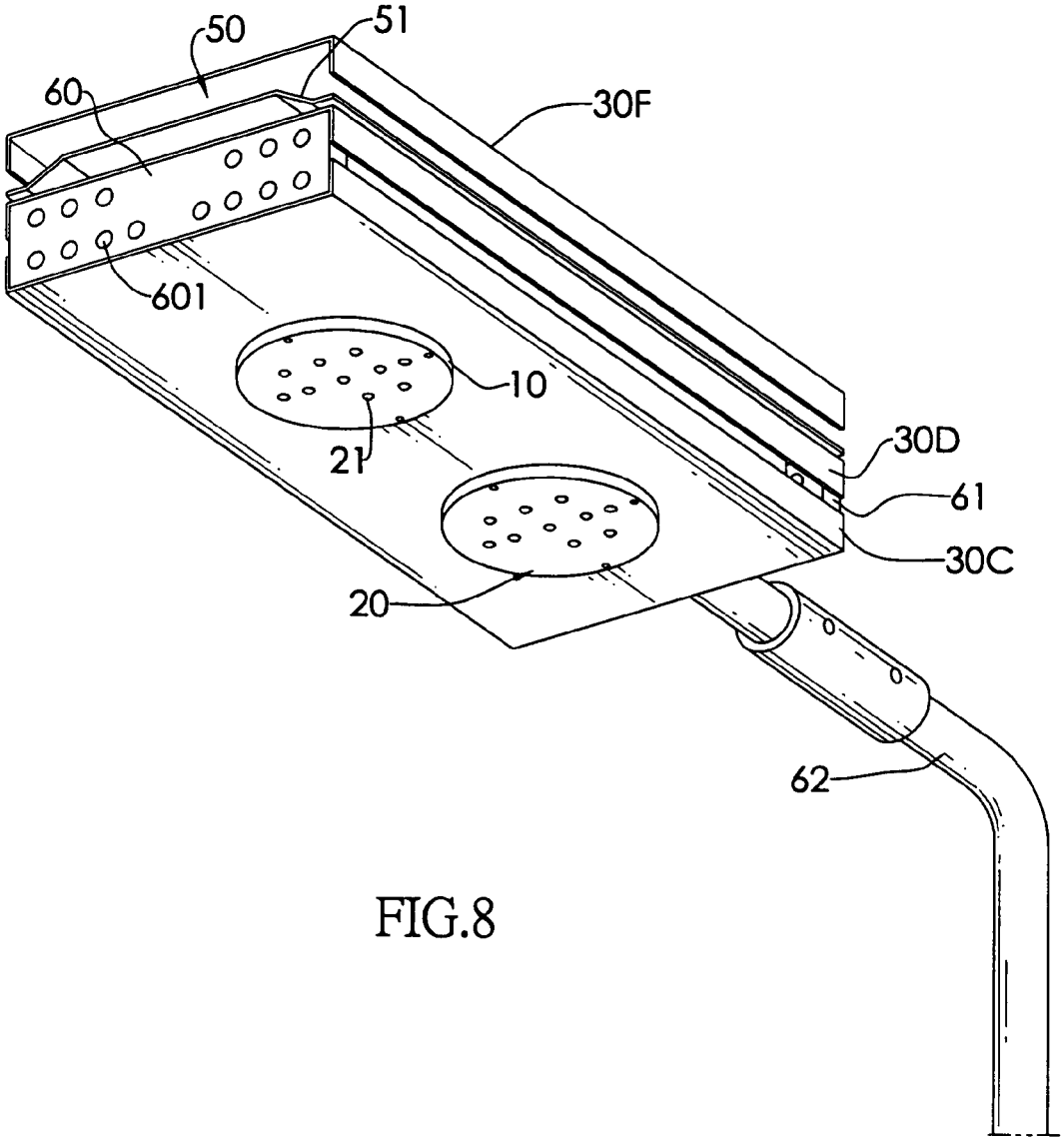
FIG. 8 is a perspective view of a fifth embodiment of the lighting device with a multiple layer cooling structure in accordance with the present invention.
Figure 9:
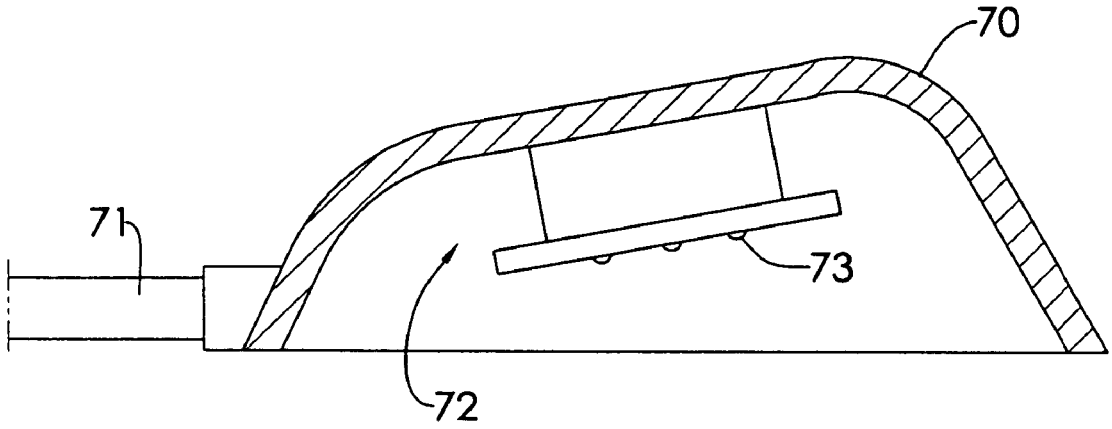
FIG.9 PRIOR ART
FIG. 9 is a side view of a conventional lighting device in accordance with the prior art.

The at least one light assembly (20) is mounted on the front end of the mounting bracket (10) has multiple light emitting diodes (LEDs) (21). In a fifth embodiment as shown in FIG 8, the lighting device has two of the mounting brackets (10). When the amount of the mounting brackets (10) increases, more light assemblies can be arranged to make the lighting device provide a brighter lighting effect.

Multiple heatsinks (30, 30A, 30B, 30C, 30D, 30E) are stacked on each other. Each heatsink (30, 30A, 30B, 30C, 30D, 30E) has at least one through hole and a side. The at least one through hole is formed through the heatsink (30) (30A, 30B, 30C, 30D, 30E) and allows the mounting bracket (10) to extend through and engages with one of the shoulders (11) to mount the heatsink (30, 30A, 30B, 30C, 30D, 30E) on a corresponding one of the shoulders (11) of a corresponding one of the mounting bracket (10) to be able to have a heat transfer's function. A fixing way of the at least one heatsink (30) (30A, 30B, 30C, 30D, 30E) and the at least one mounting bracket (10) may be screwed or wielded.

In a first and a second embodiments of the lighting device with a multiple layer cooling structure, the heatsink (30. 30A) is curved. The curved heatsinks (30, 30A) are for indoor use. In the first embodiment of the lighting device with a multiple cooling layer cooling structure, the heatsink (30) further has a reflection surface (31). The reflection surface (31) is next to the light assembly (20) and is able to reflect light from the light assembly (20).

Figure 7:
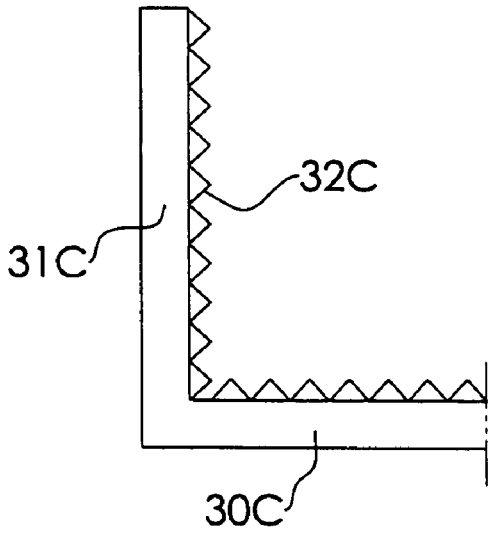
FIG. 7 is an enlarged front view of a heatsin.k with a rough surface.

In the second, a third, a fourth and a fifth embodiments, the heatsink (30B, 30C, 30D, 30E) is flat. The heatsink (30A, 30B, 30C, 30E) further has multiple optional fins (31A, 31B, 31C, 31E). The fins (31A, 31B, 31C, 31E) are formed on side of the heatsink (30A, 30B, 30C, 30E) and extend up. With reference to FIG. 7, furthermore, the side of the heatsink (30C) is a rough surface (32C). The rough surface (32C) of the heatsink (30C) is able to increase cooling area of the heatsink (30C) to increase the cooling effect to the light assembly (20).

Figure 5:
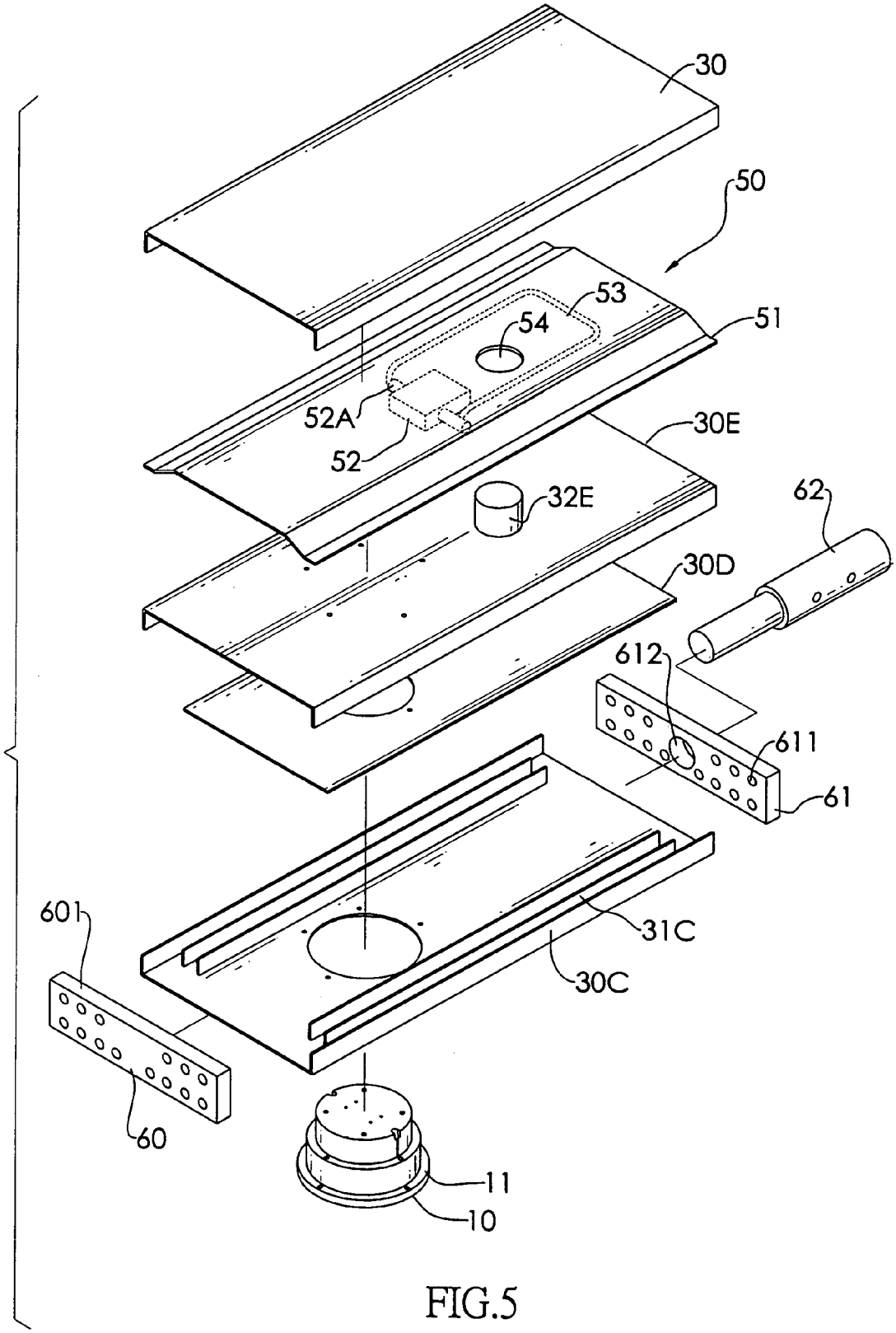
FIG. 5 is an exploded perspective view of the lighting device in FIG. 4.
Figure 6:
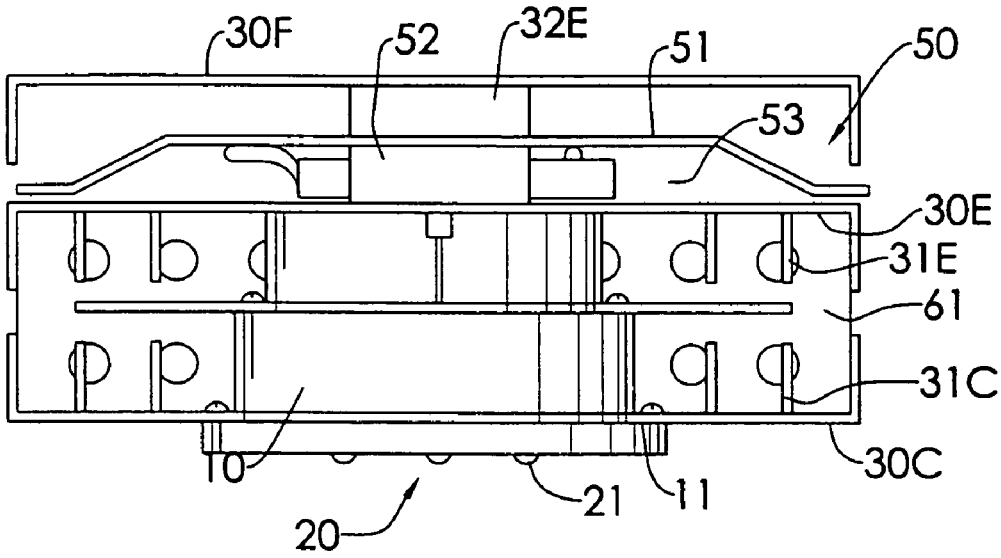
FIG. 6 is an end view in partial section of the lighting device in FIG. 4.

With reference to FIG. 5 and 6, the fourth and fifth embodiments of the lighting device further have an optional cooling module assembly (50), an optional outer heatsink (30F), an optional front supporting bracket (60) and an optional rear supporting bracket (61). The heatsink (30E) further has an optional extension (32E). The cooling module assembly (50) has a heatsink (51), a cooling pipe (53) and a cooling block (52) with steamers (52A). The heatsink (51) has at least one optional hole (54) and a side surface. The at least one hole (54) is formed through the heatsink (51) and allows the extension (32E) of the heatsink (30E) to extend through. The cooling block (52) with steamers (52A) is mounted on the side surface of the heatsink (51) of the cooling module assembly (50). The cooling pipe (53) is connected to the steamer (52A) of the cooling block (52) and has cooling fluid inside and a side. The side of the cooling pipe (53) is contacted with the side surface of the heatsink (51). The outer heatsink (30F) is mounted on the extension (32E) of the heatsink (30E) to protect the cooling module assembly (50) from bird dropping, stone or any other may damaging the cooling module assembly (50).

The front supporting bracket (60) and the rear supporting bracket (61) are mounted between two of the heatsinks (30E, 30C) to give enough supporting force to the two of the heatsinks (30E, 30C). The front supporting bracket (60) has multiple wind holes (601). The wind holes (601) are formed through the front supporting bracket (60) and allow wind to pass through. The rear supporting bracket (61) has multiple wind holes (611) and a mounting hole (612). The wind holes (611) and the mounting hole (612) are formed through the rear supporting bracket (61).

The mounting rod (40, 62) has a distal end and a proximal end. In the first, second and third embodiments, the distal end of the mounting rod (40) is connected to the rear end of the at least one mounting bracket (10). The proximal end of the mounting rod (40) is mounted at any required location where light is required.

In the fourth and first embodiments, the distal end of the mounting rod (62) extends through and mounts in the mounting hole (612) in the rear supporting bracket (61).

When the light device (20) emits light, each LED (21) generates heat. The heat from the each LED (21) drive to the mounting bracket (10) and then the heat will transfer to each heatsink (30, 30A, 30B, 30C, 30D, 30E, 30F). The heat from the each LED (21) convects to air. The each LED (21) is able to cool down and avoids to bum down.

Furthermore, in the fourth and fifth embodiments, the heat from the each LED (21) also transfers to the cooling module assembly (50). The cooling fluid of the cooling pipe (53) vapors. Steam of the cooling fluid goes through the cooling pipe (53) and the cooling block (52). The steam of the cooling fluid is cooled down and transforms back to the cooling fluid again in the steamers (52A) of the cooling block (52). However, the light assembly (20) is able to be cooled down more effectively.

The mounting bracket (10) and the heatsink (30) (30A, 3OB, 30C, 30D), 30E, 30F) are easy to manufacture and assemble so that total cost of making the lighting device with a multiple layer cooling structure can be lower and economical. Furthermore, the heatsink (30)(30A, 30B, 30C, 30D, 30E, 30F) is able to be changed so its shape can fit any look requirement and the requirement of a big cooling area.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A lighting device with a multiple layer cooling structure comprising:

at least one mounting bracket, each one of the at least one mounting bracket having a front end;

a rear end;

a side; and multiple shoulders formed at the side of the mounting bracket;

at least one light assembly mounted on the front end of the mounting bracket having multiple light emitting diodes;

multiple heatsinks stacked on each other, each heatsink having a side, at least one through hole formed through the heatsink and allowing one of the at least one mounting bracket to extend through and engage one of the shoulders to mount the heatsink on a corresponding one of the shoulders of a corresponding one of the at least one mounting bracket, and multiple fins formed on the side of the heatsink and extending up and the side of the heatsink defines a rough surface;

a front supporting bracket having multiple wind holes formed through the front supporting bracket;

a rear supporting bracket having multiple wind holes formed through the rear supporting bracket and mounted between two heatsinks to support the heatsinks; and a cooling module assembly coupled to one of the multiple heatsinks and including a heatsink having a side surface, a cooling block with steamers mounted on the side surface of the heatsink of the cooling module assembly and a cooling pipe connected to the steamer of the cooling block and having cooling fluid inside and a side contacted with the side surface of the heatsink of the cooling module assembly.

2. The lighting device as claimed in claim 1 further has a mounting rod having a distal end and a proximal end; and the rear supporting bracket further has a mounting hole formed through the rear supporting bracket, and the distal end of the mounting rod extends through and mounts in the mounting hole in the rear supporting bracket.

3. The lighting device as claimed in claim 2, wherein one of the heatsinks is an outer heatsink and has an extension;

the heatsink of the cooling module assembly further has at least one hole formed through the heatsink allowing the extension of the outer heatsink to extend therethrough;

the lighting device further has an outer heatsink mounted on the extension of the heatsink.

4. The lighting device as claimed in claim 1, wherein the heatsink is flat.

5. The lighting device as claimed in claim 1, wherein the heatsink is curved.

6. The lighting device as claimed in claim 5, wherein the heatsink further has a reflection surface being next to the light assembly.

7. The lighting device as claimed in claim 6 further has a mounting rod mounted on the rear end of the mounting bracket.

* * * * *